US005106164A

United States Patent [19]

Kitzinger et al.

[11] Patent Number: 5,106,164

[45] Date of Patent: Apr. 21, 1992

[54] PLASMA BLASTING METHOD

[75] Inventors: Frank Kitzinger, Montreal; Jacques Nantel, Pointe-Claire, both of Canada

[73] Assignee: Noranda Inc., Toronto Ontario, Canada

[21] Appl. No.: 660,767

[22] Filed: Feb. 26, 1991

[30] Foreign Application Priority Data

Apr. 20, 1990 [CA] Canada ..... 2015102

[51] Int. Cl.[5] ..... E21C 37/18

[52] U.S. Cl. ..... 299/14; 166/63; 175/16

[58] Field of Search ..... 299/13, 14; 175/16; 166/60, 63, 65.1, 299

[56] References Cited

U.S. PATENT DOCUMENTS

| | | | |
|---|---|---|---|
| 3,158,207 | 11/1964 | Rowley . | |
| 3,208,647 | 9/1965 | Bailey | 299/14 X |
| 3,283,294 | 11/1966 | Schrom | 166/63 X |
| 3,364,708 | 1/1968 | Padberg, Jr. . | |
| 3,500,942 | 3/1970 | Smith, Jr. . | |
| 3,583,766 | 6/1971 | Padberg, Jr. | 299/14 |
| 3,679,007 | 7/1972 | O'Hare | 175/16 |
| 4,897,577 | 1/1990 | Kitzinger | 315/55 |

FOREIGN PATENT DOCUMENTS

| | | | |
|---|---|---|---|
| 1284385 | 12/1968 | Fed. Rep. of Germany | 299/14 |
| 2435580 | 2/1975 | Fed. Rep. of Germany | 299/14 |
| 357345 | 7/1983 | U.S.S.R. | 299/14 |

OTHER PUBLICATIONS

"The Electrohydraulic Crusher", Feb. 1961, pp. 134–140, Engineering and Mining Journal.

"Electrohydraulic Effect—a New Energy Source for Rock Fragmentation?", Feb. 1970, pp. 88–89, Engineering and Mining Journal.

Novel comminution Process Uses Electric and Ultrasonic Energy, Parekh, et al., Sep. 1984, pp. 1305–1309.

The Electrohydraulic Effect: Potential Application In Rock Fragmentation, Kutter, 1969, pp. 1–35.

*Primary Examiner*—David J. Bagnell

*Attorney, Agent, or Firm*—Fleit, Jacobson, Cohn, Price, Holman & Stern

[57] ABSTRACT

A blasting method which comprises delivering electrical energy at a rate of at least 100 megawatts per microsecond until a peak power of at least 3 gigawatts is reached across the gap of two poles of a coaxial electrode assembly immersed in an electrolyte within a confined area of a substance to be blasted. A dielectric break-down of the electrolyte in the confined area is produced resulting in the formation of plasma within the confined area which creates a pressure sufficient to blast the substance in the manner of a high explosive charge.

6 Claims, 3 Drawing Sheets

PLASMA BLASTING METHOD

This invention relates to a plasma blasting process for fragmenting a substance such as rock and more particularly for hard rock mining.

The traditional method of hard rock mining is a batch process with the following sequence: Holes are drilled in the rock, chemical explosives placed into the holes, and the mine personnel evacuated; then the explosives are detonated, causing a quantity of rock to be separated from the solid rock mass; gases generated by the explosives are then ventilated out before the miners can return.

Over the years many attempts were made to improve efficiency of hard rock mining, by continuously working the ore face, chipping away the rock in smaller chunks. In general, continuous mechanical mining machinery is suitable for softer, more easily workable rock types only.

Electrical methods for hard rock fragmentation were tried by several researchers. One such technique is electrohydraulic crushing which was tested as early as 1905 by Svedberg. He produced colloidal metallic suspensions by capacitor discharge in a liquid as reported by B. H. Parekh, et al. in an article entitled "Novel Comminution Process Uses Electric and Ultrasonic Energy", Mining Engineering, September 1984, pages 1305–1309. The electrohydraulic effect and its potential application in rock fragmentation has been extensively studied by H. K. Kutter and published by the U.S. Bureau of Mines in 1969 (see Report of Investigations 7317 entitled "The Electrohydraulic Effect: Potential Application in Rock Fragmentation"). Additional publications on the electrohydraulic effect can be found in Engineering and Mining Journal, Volume 62 (2) 1961, pages 134 to 140 where an electrohydraulic crusher is described and in Engineering and Mining Journal of February 1970 pages 88–89 where a summary of the U.S. Bureau of Mines report mentioned above is given.

Several patents have also been issued in this area which have recognized the importance of electrical discharge in water to generate shock waves. For example, U.S. Pat. No. 3,158,207 of Nov. 24, 1964 to D. S. Rowley provides a spark discharge drill operating on this principle. U.S. Pat. No. 3,364,708 of Jan. 23, 1968 to L. R. Padberg, Jr. gives a good overall review of this phenomenon. Also, U.S. Pat. No. 3,500,942 of Mar. 17, 1970 to N. D. Smith, Jr; U.S. Pat. No. 3,583,766 of June 8, 1971 to L. R. Padberg, Jr. and U.S. Pat. No. 3,679,007 of July 25, 1972 to O'Hare relate to drills in which an electric discharge takes place between two electrodes immersed in a fluid such as water, thereby producing a high temperature, high pressure plasma between the electrodes. The expansion of the plasma produces a strong pressure or shock wave which enhances the drilling effect. The main disadvantages of electrohydraulic fracturing are that the pressure pulse is spread out and a large fraction of energy is dissipated in the water (see B.K. Parekh, et al., Supra).

Applicant has now surprisingly found that by delivering electrical energy at a rate of at least 100, preferably in excess of 200 megawatts per microsecond until a peak power of at least 3, preferably in excess of 4 gigawatts is reached across the gap of two poles of a coaxial electrode assembly immersed in an electrolyte within a confined area of a substance to be blasted, one can produce a dielectric break-down of the electrolyte resulting in the formation of plasma within such confined area which creates a pressure sufficient to blast such substance in the manner of a high explosive charge.

The electrolyte could be water or a solution suitable for dielectric breakdown. A preferred solution is that of copper sulphate.

The electrolyte may also be combined with a gelling agent such as bentonite or gelatin in order to make it viscous enough so that it would not run out of the confined area prior to blasting.

The invention will now be disclosed, by way of example, with reference to the accompanying drawings in which.

Figure 1:
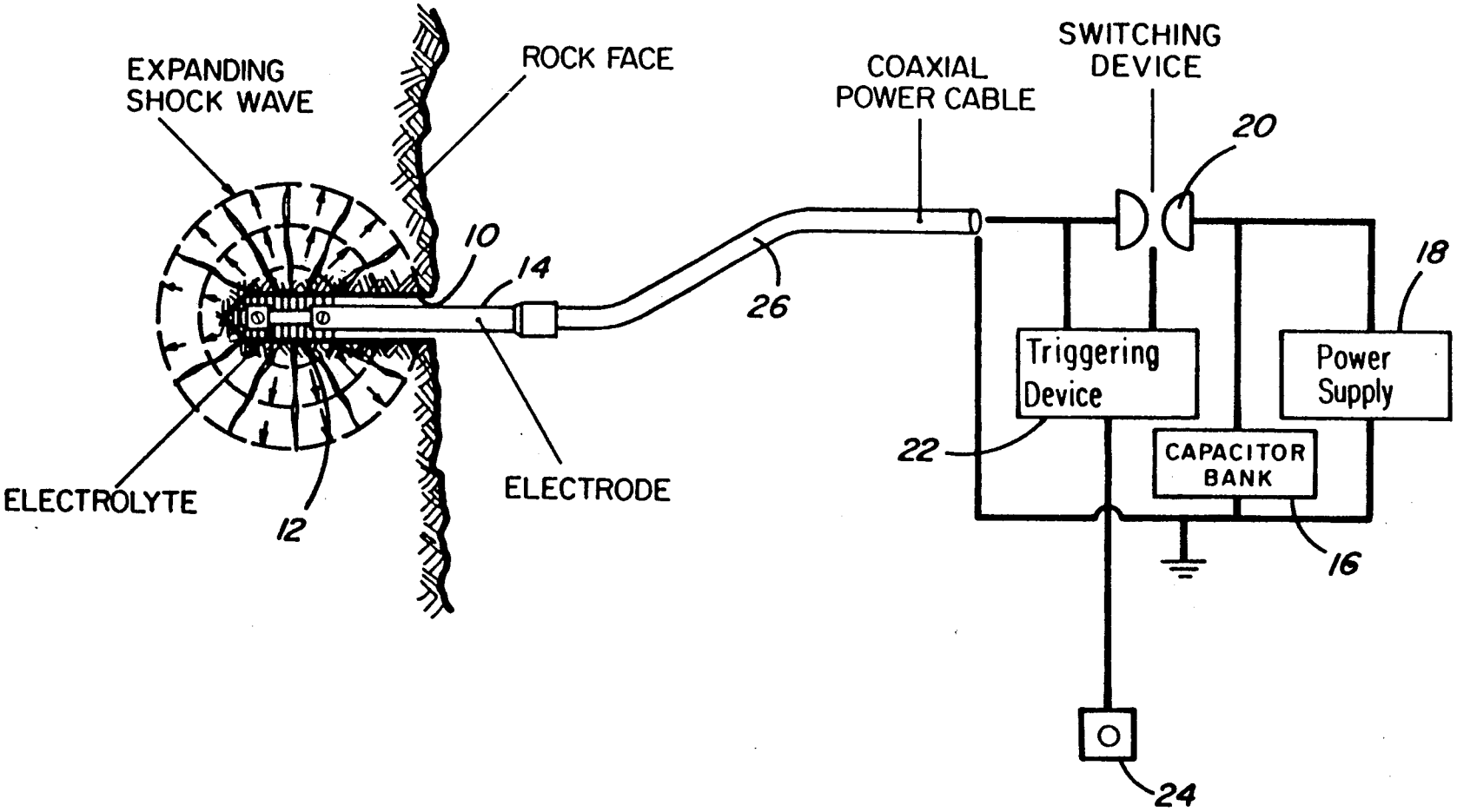
FIG. 1 is a schematic diagram of the equipment required for the storage and release of electrical energy for the plasma blasting process in accordance with the present invention.
Figure 2:
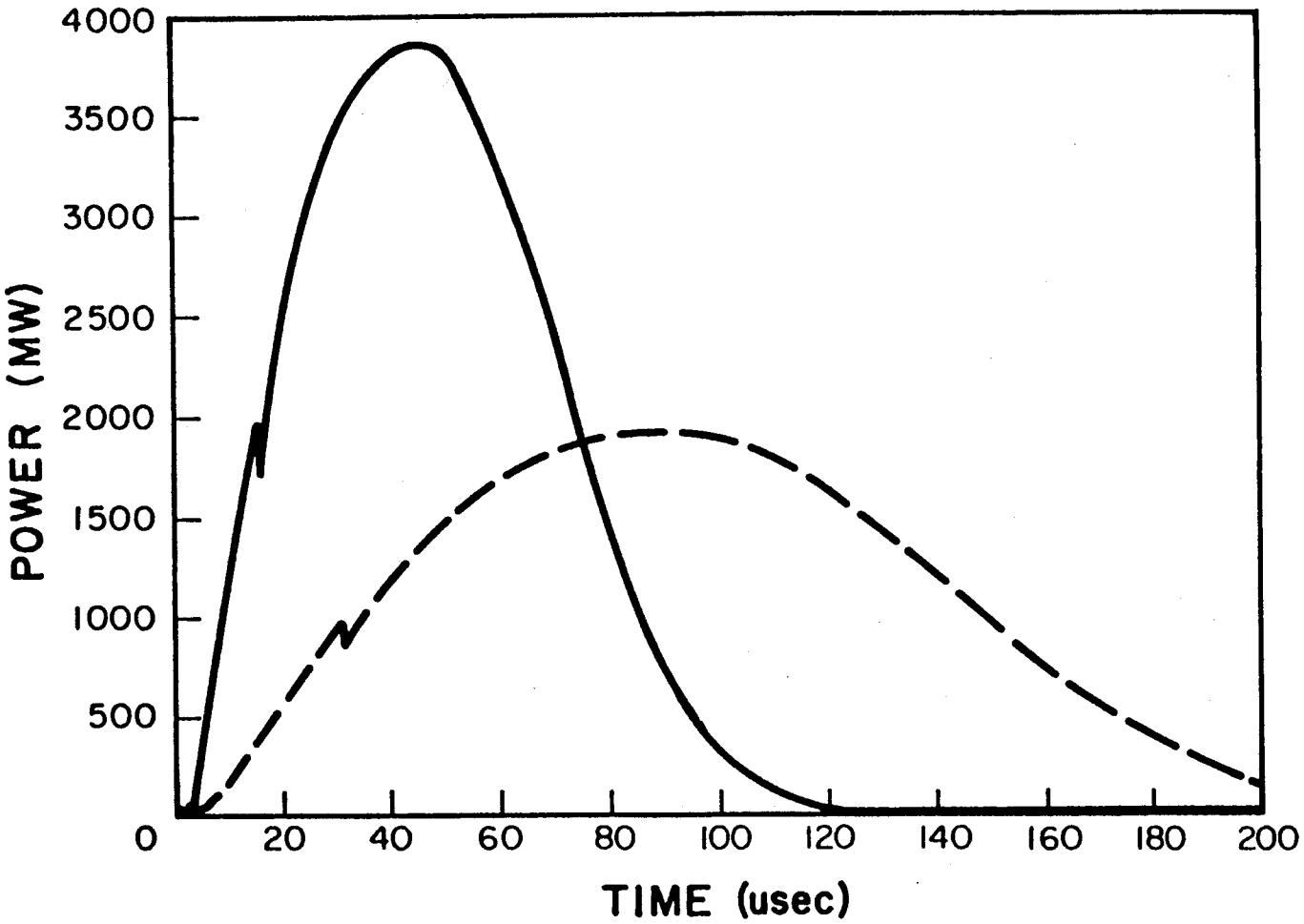
FIG. 2 is a diagram illustrating the rate of energy and the peak power required to break the rock.

Referring to FIG. 1, the plasma blasting method in accordance with the present invention requires drilling of a hole 10 into the rock face by conventional drilling. A small amount of viscous electrolyte 12, such as copper sulphate, is injected into the hole and a coaxial blasting electrode 14 is inserted in the hole. Electrical energy, typically 300–1000 kilojoules, is delivered into approximately 20–50 grams of the electrolyte under confinement within the hole. Typical dimensions for the hole are about 50 mm diameter and 500 mm depth. These dimensions may change depending on the size of the blasting electrode and the amount of energy input. The diameter of the hole should be such that the blasting electrode would have a close fit and the greater the energy input the deeper the hole would be. The blasting electrode which fits closely into the hole serves two purposes: (1) it carries electrical energy to the electrolyte, (2) it produces the required confinement for the blast by plugging up the hole. Rapid delivery of the electrical energy is important for the development of the desired high peak pressure. Typical energy delivery rate is at least 100 and preferably in excess of 200 megawatts per microsecond until a peak power of at least 3 gigawatts and preferably in excess of 4 gigawatts is reached as illustrated in FIG. 2 of the drawings. The peak pressure developed has been found to be in excess of 1 gigapascal, or 10,000 atmospheres which is sufficient to blast hard rock in the manner of a high explosive charge. Applicant has found that if the energy delivery rate is lower than 100 megawatts per microseconds such as that illustrated, for example, by the dotted line in FIG. 2, or the peak power substantially less than 3 gigawatts, insufficient pressure is created to adequately blast the rock,, although the amount of energy delivered (area under the curves) is essentially the same.

The electrical energy required for the blast is conveniently stored in a capacitor bank 16 which is electrically charged by a suitable D.C. power supply 18. A high current switch 20, such as the one described in U.S. Pat. No. 4,897,577, is used to direct typically 500 kiloamperes to the blasting electrode at the time of blast. The switch is triggered by a triggering device 22 which is initiated by a remote trigger 24 through a fiber optic cable or a pneumatic tube to provide perfect electrical isolation for the operator. The capacitor bank is connected to the blasting electrode through an electrical circuit including a coaxial power cable 26 which is designed for minimum inductance and resistance to reduce power losses and ensure rapid discharge of energy (at the above disclosed rate) into the rock for the development of an intense shockwave.

Prior to the blast, the electrode is maintained at ground potential but when the switch is triggered the center lead of the coaxial electrode is raised to the high voltage of the capacitor bank. The electrolyte in the hole then suffers a dielectric breakdown producing a plasma at extremely high temperature and pressure. In this manner, a great amount of energy is transferred within a very short time from the capacitor bank into the small amount of electrolyte in the confined area around the electrode thereby instantaneously transforming this entire finite amount of electrolyte into plasma which must then release this energy by way of a pressure wave, thus resulting in a blast similar to that made by dynamite or other chemical explosives.

The plasma electrode may be equipped with a recoil mechanism to damp out the destructive effect of the blast on the electrode.

Figure 3:
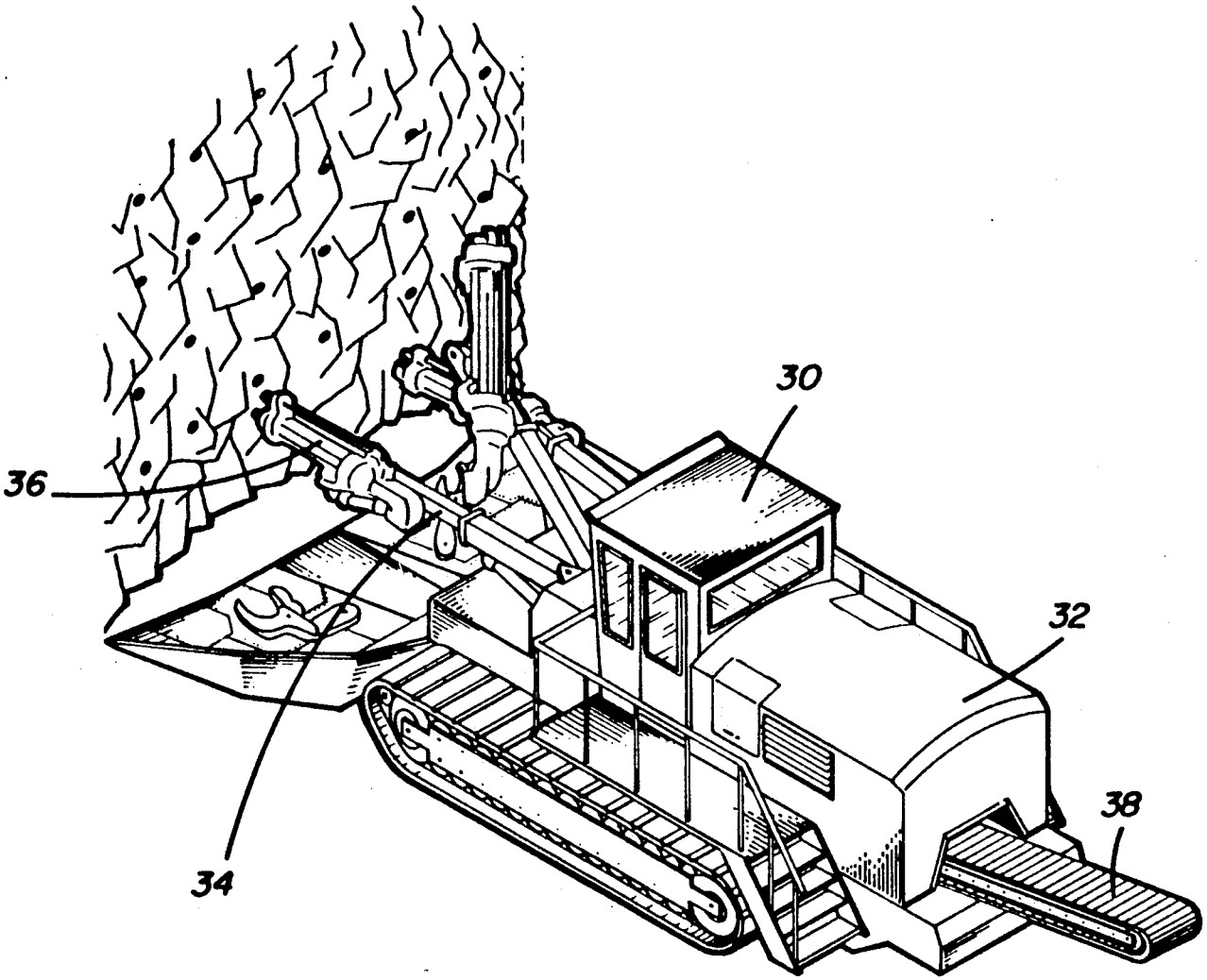
FIG. 3 is a diagram of a continuous mining and tunneling machine for plasma blasting.

FIG. 3 is a diagram of a continuous mining and tunneling machine 30 at the back of which is mounted the capacitor bank and associated equipment 32 for triggering a blasting electrode mounted on one or several booms 34 located at the front of the machine. A drilling and blasting head 36 is provided at the end of the boom. The rock blasted from the mine face is collected at the front of the machine onto a conveyor 38 extending to the back of the machine for loading into conventional transport equipment.

Although the invention has been disclosed with reference to a preferred embodiment, it is to be understood that it is not limited to such embodiment and that other alternatives are also envisaged within the scope of the following claims.

We claim:

1. A blasting method which comprises drilling a hole in a substance to be blasted, injecting a predetermined amount of electrolyte into the hole, inserting a coaxial electrode having two poles separated by a gap into the hole, the diameter of the coaxial electrode being such as to produce a confined area filled with electrolyte within the hole when the coaxial electrode is inserted in the hole, and delivering electrical energy to the coaxial electrode at a rate of at least 100 megawatts per microsecond until a peak power of at least 3 gigawatts is reached across the gap of the two poles of the coaxial electrode, so as to produce a dielectric break-down of the electrolyte resulting in the formation of plasma within said confined area which creates a pressure sufficient to blast said substance in the manner of a high explosive charge.

2. A method according to claim 1, in which the energy delivery rate is in excess of 200 megawatts per microsecond.

3. A method according to claim 2, in which the peak power is in excess of 4 gigawatts.

4. A method according to claim 1, in which the electrolyte is a solution of copper sulphate.

5. A method according to claim 1, further comprising combining a gelling agent with the electrolyte to increase its viscosity.

6. A method according to claim 5, in which the gelling agent is bentonite.

* * * * *